US010058182B2

(12) United States Patent
Zonneveld

(10) Patent No.: US 10,058,182 B2
(45) Date of Patent: Aug. 28, 2018

(54) LOUNGE BAG AND METHOD FOR PRODUCING A LOUNGE BAG TO BE FILLED WITH AIR

(71) Applicant: Fatboy the original B.V., 's Hertogenbosch (NL)

(72) Inventor: Robertjan Zonneveld, 's Hertogenbosch (NL)

(73) Assignee: FATBOY THE ORIGINAL B.V., 'S Hertogenbosch (NL)

( * ) Notice: Subject to any disclaimer, the term of this patent is extended or adjusted under 35 U.S.C. 154(b) by 80 days.

(21) Appl. No.: 15/389,525

(22) Filed: Dec. 23, 2016

(65) Prior Publication Data

US 2018/0035807 A1 Feb. 8, 2018

(30) Foreign Application Priority Data

Aug. 4, 2016 (NL) ..... 2017291

(51) Int. Cl.
*A47C 7/02* (2006.01)
*A47C 4/54* (2006.01)
*A47C 1/14* (2006.01)

(52) U.S. Cl.
CPC ..... *A47C 4/54* (2013.01); *A47C 1/146* (2013.01)

(58) Field of Classification Search
CPC ..... A47C 4/54; A47C 1/146
USPC ..... 297/452.41
See application file for complete search history.

(56) References Cited

U.S. PATENT DOCUMENTS 5,951,716 A * 9/1999 Lucia, III ..... C11D 1/86 442/164
9,103,482 B2 * 8/2015 Fujimori ..... F16L 59/065
2004/0255379 A1 * 12/2004 Zheng ..... A47C 4/54 5/413 AM
2007/0080078 A1 * 4/2007 Hansen ..... B65D 81/3266 206/219
2008/0085386 A1 * 4/2008 Ajiri ..... A61F 7/03 428/35.2
2009/0007402 A1 * 1/2009 Carroll ..... A61G 17/06 27/28
2010/0140995 A1 * 6/2010 Everett ..... A47C 4/54 297/230.1
2010/0209025 A1 * 8/2010 Futase ..... B65D 75/008 383/113
2012/0246991 A1 * 10/2012 Seuk ..... F41C 33/001 42/94
2015/0250328 A1 * 9/2015 Brechet ..... A47C 27/086 297/452.41

* cited by examiner

*Primary Examiner* — Mark R Wendell
(74) *Attorney, Agent, or Firm* — Shumaker, Loop & Kendrick, LLP

(57) ABSTRACT

A method for producing a lounge bag adapted to be filled with air including providing an elongate cloth having two transverse edges and two longitudinal edges, folding the cloth about a first folding edge and subsequently about a second folding edge, bonding outer cloth parts together on the side of the transverse edges to provide an airtight seal, bonding the four opposite cloth parts together on the side of the longitudinal edges, turning the cloth inside out, and fixing a seal to the transverse edges forming part of the third and fourth cloth parts. A lounge bag produced according to the method.

14 Claims, 4 Drawing Sheets

LOUNGE BAG AND METHOD FOR PRODUCING A LOUNGE BAG TO BE FILLED WITH AIR

TECHNICAL FIELD AND BACKGROUND

The present invention relates to a method for producing a lounge bag to be filled with air. At the time of the present invention, the Roomox™ company markets a lounge bag to be filled with air under the designation "Air Lounge". When filled with air, the known lounge bag has substantially the shape of two side-by-side tubes, which are in communication with each other inside the lounge bag, so that air can flow from one tube to the other tube. Present between the two tubes is a central gap, which extends in the longitudinal direction of the lounge bag. The shape in question essentially corresponds to the shape of the lounge bag as shown in FIG. 8. At the location of the gap, the two tubes are interconnected in the middle of the height of the lounge bag, where four cloth parts of the wall of the lounge bag meet. More specifically, the two cloth parts of two pairs of cloth parts are stitched together, and longitudinal edges of these two pairs butt together with a longitudinal seam therebetween, with tape being applied to either side of this longitudinal seam. It has been found that in use this joint can move downward under the influence of the weight of an individual reclining between the two tubes on the lounge bag, because the two tubes can roll in opposite directions relative to each other. It has further been found that the connection can be partially lost in use, so that air can flow from one tube to the other tube via the longitudinal seam, which adversely affects the shape stability of the lounge bag and also the comfort that an individual experiences during use of the lounge bag. Because of the relative weakness of the joint, clamping elements provided with screwed connections are used at the ends thereof. This complicates the production process.

BRIEF SUMMARY OF THE INVENTION

An object of the invention is to ameliorate the aforesaid drawbacks of the known lounge bag, whether or not in preferred embodiments of the invention. In order to achieve that object, the invention in the first place provides a method for producing a lounge bag to be filled with air, the lounge bag comprising a container with a wall made of an airtight cloth and an interior space enclosed by the wall, which container is provided with an air inlet opening for admitting air into the interior space via the air inlet opening when an individual moves the air inlet opening through air, the container further comprising sealing means for hermetically sealing the air inlet opening after air has been captured in the interior space.

In one embodiment, the method includes the steps of: (a) providing an elongate, at least substantially rectangular cloth having two opposite transverse edges and two opposite longitudinal edges, where the cloth is first folded double in a first direction about a first folding edge by placing the transverse edges one on top of the other and then is subsequently folded double about a second folding edge in a second direction oriented perpendicular to the first direction, thus forming four cloth parts stacked against each other, more specifically a first and a fourth cloth part that are positioned on opposite outer sides, at least during step (c), a second cloth part, which is positioned against the first cloth part, and a third cloth part, which is positioned between the second cloth part and the fourth cloth part; (b) bonding the first cloth part and the second cloth part together on the side of the transverse edge insofar as it forms part of the first cloth part and the second cloth part so as to provide an airtight seal; (c)

bonding the four opposite cloth parts together on the side of the longitudinal edges insofar as the longitudinal edges form part of the first cloth part up to and including the fourth cloth part, in a direction parallel to said longitudinal edges; (d) turning the cloth with the bonded-together cloth parts as obtained in step (c) inside out by passing the first folding edge between the third cloth part and the fourth cloth part, so that the first cloth part and the second cloth part will be positioned between the third cloth part and the fourth cloth part and the air inlet opening will be present on the side opposite the first folding edge, which air inlet opening is surrounded by the transverse edge insofar as it forms part of the third cloth part and the fourth cloth part; and (e) fixing the sealing means to the transverse edge insofar as it forms part of the third cloth part and the fourth cloth part.

By using this method, a lounge bag with an improved connection between the four cloth parts is obtained, because the cloth parts are bonded together in a butted-together position, so that there is no longitudinal seam between the respective cloth parts, as is the case with the prior art lounge bag. An additional advantage is the fact that the joint between the tube parts obtained by bonding the four cloth parts together will exhibit significantly more resistance to moving downward, so that individuals or objects cannot completely sink into the space between the tube parts of the lounge bag. Within the scope of the invention, the aforesaid steps a-e can also be carried out in a different order than presented herein. Steps (b) and (c), for example, can be carried out in the reverse order and/or step € can be carried out prior to step (d).

A suitable bond between the four butted-together cloth parts can be obtained if said four butted-together cloth parts are stitched together using a stitched seam during step (c). The stitched seam will in that case extend through all four butted-together cloth parts.

The risk of air flowing between the four butted-together cloth parts from one longitudinal side of the lounge bag to the opposite longitudinal side via the seam, more specifically via the stitching holes, can be significantly reduced if a tape is applied to the first cloth part and/or the fourth cloth part over the stitched seam after step (c). The word "tape" is understood to mean a strip of a flexible, airtight plastic material provided with an adhesive layer on at least one side. The tape adds to the strength of the bond. In one embodiment, the tape is a seam sealing tape in the form of a heat seal tape or, in other words, a hot melt tape. Such a tape is laid over the stitched seam and subsequently heated so as to obtain a durable, airtight bond between the tape and the cloth.

In order to prevent air flowing between the four butted-together cloth parts at the stitched seam, it may be advantageous if, prior to the application of the tape as described in the preceding paragraph, the butted-together strips of cloth material positioned between the stitched seam and the respective longitudinal edges forming part of the four bonded-together cloth parts are folded about the stitched seam against the first cloth part or against the fourth cloth part, wherein the tape is applied also over the longitudinal edges that form part of the four bonded-together cloth parts.

The risk of air flowing from one longitudinal side of the lounge bag to the opposite longitudinal sides via the joint, more specifically via the stitching holes, can be reduced even further if a further tape is applied to the second cloth part and the third cloth part over the stitched seam after the application of the tape as described in the foregoing.

If prior to step (b) the transverse edges insofar as they form part of the first cloth part and the second cloth part are cut out in such a manner that the transverse edges insofar as they form part of the first cloth part and the second cloth part assume a concave configuration, and during step (b) the first cloth part and the second cloth part are bonded together according to said concave configuration, air can flow more easily into the air inlet opening in use. Furthermore, a better circulation of air is now possible in the interior space after the air inlet opening has been sealed using the sealing means once air has been captured in the interior space. Because of the concave configuration, tensions in the cloth at or near the air inlet opening, for example at the point of conversion of the first up to and including the fourth cloth part on the side of the longitudinal edge insofar as it forms part of the first cloth part up to and including the fourth cloth part, can furthermore be reduced because the transverse edges insofar as they form part of the first cloth part and the second cloth part will join the third and the fourth cloth part more parallel to the longitudinal edge as a result of the aforesaid cutting out. The aforesaid point of conversion may be located at the air inlet opening or near the air inlet opening, for example at a distance of 5 to 30 centimetres, for example about 20 cm, from the air inlet opening. A further effect of the aforesaid concave configuration is that sealing the air inlet opening using the sealing means will be easier because material of the first and the second cloth part is spaced further away from the air inlet opening and the risk of interference of said cloth part material with the sealing means will be smaller. Preferably, the aforesaid concavity is an at least substantially continuous concavity, but alternatively it is conceivable that the concavity comprises one or more straight parts and is thus an angular concavity.

Furthermore, the method according to the invention includes, as part of step (e), the steps of (i) attaching a first flexible slat having a length of at least substantially the entire length of the transverse edge insofar as it forms part of the third cloth part to the third cloth part at the transverse edge thereof; (ii) attaching a second flexible slat having a length of at least substantially the entire length of the transverse edge insofar as it forms part of the fourth cloth part to the fourth cloth part at the transverse edge thereof; and (iii) providing a first connecting element to the lounge bag at ends located near each other of the first slat and the second slat and providing a second connecting element to the lounge bag at two ends located near each other, opposite said first ends, of the first slat and the second slat, where first and second connecting element are configured for interconnected cooperation in the abutting, jointly bent position of the first slat and the second slat for the purpose of keeping the first slat and the second slat in the bent position.

The use of such slats is known per se from the above-described prior art lounge bag.

It is a further object to provide a lounge bag made according to the method described above. The lounge bag includes a container with a wall that is made of an airtight cloth and an interior space enclosed by the wall, where the container is provided with an air inlet opening for admitting air into the interior space via the air inlet opening as a result of an individual moving the air inlet opening through air, the container further including sealing means for hermetically sealing the air inlet opening after air has been captured in the interior space, wherein the wall has four wall parts that form part of a folded cloth having two opposite transverse edges and two opposite longitudinal edges, where the four wall parts butt together or at least can be positioned to butt together when the container is not filled with air, wherein the four cloth parts are bonded together on the side of the longitudinal edge insofar as it forms part of the first cloth part up to and including the fourth cloth part and at a position where the four cloth parts are stacked to butt together, wherein two cloth parts located on the inner side, between the two other cloth parts located on the outer side, are bonded together to form an airtight seal on the side of the transverse edge insofar as it forms part of the two cloth parts located on the inner side, and wherein the sealing means are fixed to the transverse edge insofar as it forms part of the two cloth parts located on the outer side, wherein the transverse edge insofar as it forms part of the two cloth parts located on the outer side surrounds the air inlet opening.

Preferably, the first cloth part up to and including the fourth cloth part are stitched together using a stitched seam, wherein furthermore preferably a tape is applied over the stitched seam to the inner side of a cloth part located on the outer side and/or to the cloth part adjacent thereto, on the side thereof that faces the outer cloth part, and even more preferably a further tape is applied over the stitched seam to the inner side of the other cloth part located on the outer side and/or to the cloth part thereto, on the side thereof that faces the other outer cloth part.

The transverse edge insofar as it forms part of the two inner cloth parts preferably has a concave configuration, wherein furthermore preferably the concavity does not comprise any angles. In this way concentrations of tensions at joints in the lounge bag can be prevented.

The sealing means preferably includes a first flexible slat, which is fixed to the transverse edge insofar as it forms part of one of the two outer cloth parts and which has a length at least substantially equal to the length of the transverse edge insofar as it forms part of the one cloth part, and a second flexible slat which is fixed to the transverse edge insofar as it forms part of other of the two outer cloth parts and which has a length at least substantially equal to the length of the transverse edge insofar as it forms part of the other cloth part, as well as a first connecting element at ends located near each other of the first slat and the second slat and a second connecting element at second ends located near each other, opposite said first ends, of the first slat and the second slat, which first and second connecting element are configured for interconnected cooperation, such that when the first slat and the second slat are located opposite each other in a jointly bent position, said first and second slat will be held in the bent position.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION OF THE INVENTION

The invention will now be explained in more detail by means of a description of a an embodiment of the invention, in which reference is made to FIGS. 1-8 showing a cloth during successive stages of the production of a lounge bag.

Figure 1:
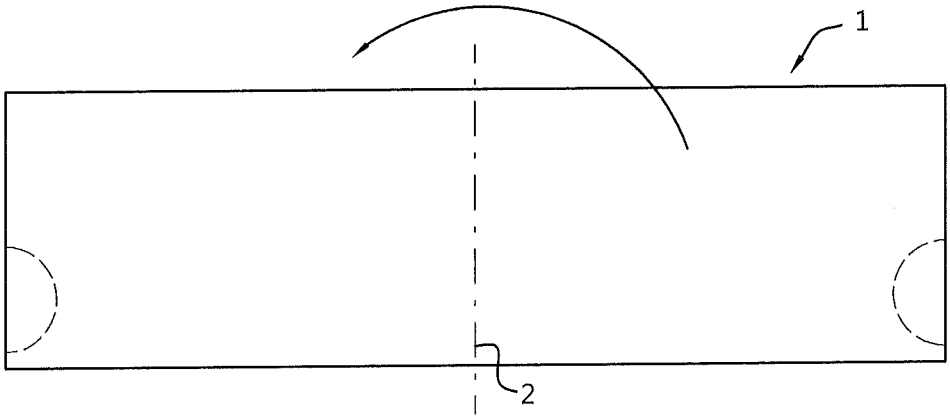
FIG. 1 shows a rectangular cloth.
Figure 2:
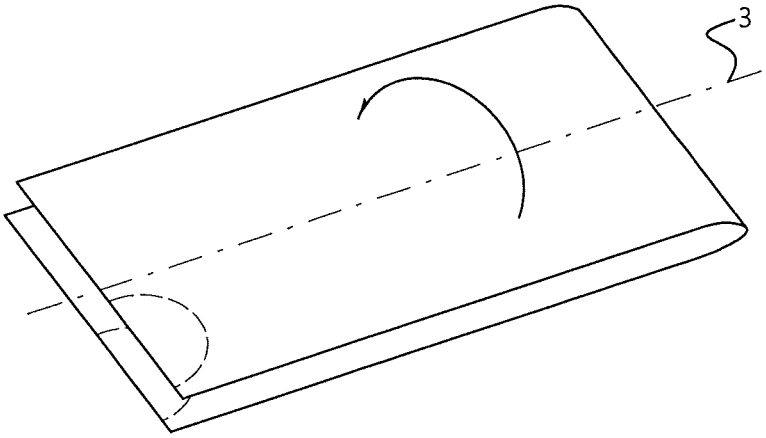
FIG. 2 shows the rectangular cloth folded.
Figure 3:
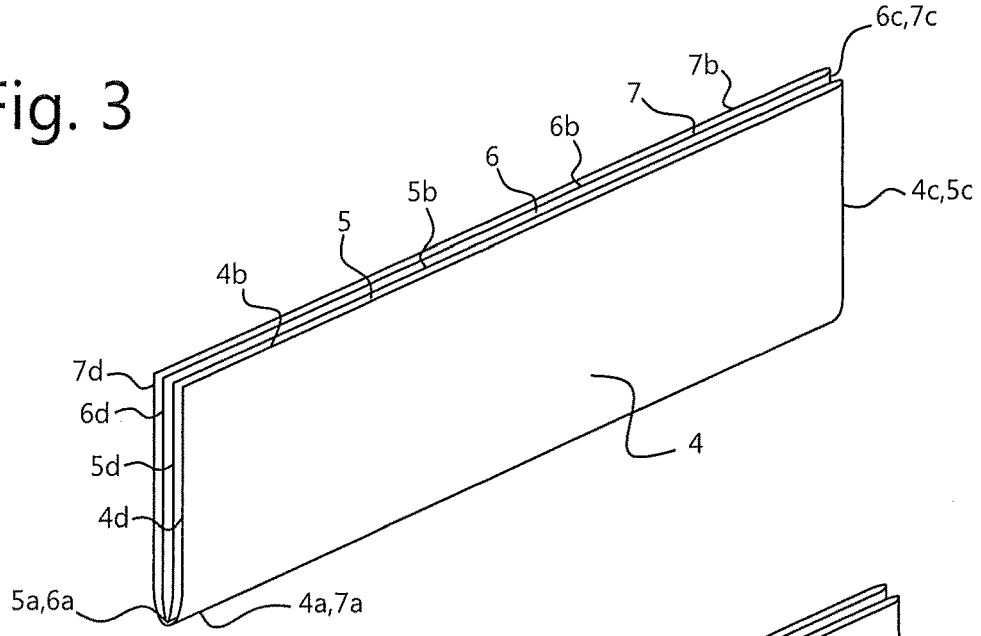
FIG. 3 shows the rectangular cloth further folded.

FIG. 1 shows a rectangular cloth 1. The cloth is made of nylon and is coated with an airtight layer, for example of thermoplastic polyurethane. The dimensions of the cloth are, for example, typically 145 cm×490 cm. The cloth has two opposite longitudinal edges and two opposite transverse edges. The cloth is folded in successively the longitudinal direction about the fold line 2 and in the transverse direction, about the fold line 3, so that four identical cloth parts 4, 5 6 and 7 lying one on top of another are formed. Each of the cloth parts 4-7 has two longitudinal edge portions 4*a*, 5*a*, 6*a*, 7*a* and 4*b*, 5*b*, 6*b*, 7*b* and two transverse edge portions 4*c*, 5*c*, 6*c*, 7*c* and 4*d*, 5*d*, 6*d*, 7*d*. The longitudinal edge portions 4*b*, 5*b*, 6*b*, 7*b* and the transverse edge portions 4d, 5d, 6d, 7d are "free" edges and form part of the two longitudinal edges and the two transverse edges of the cloth 1.

Figure 4:
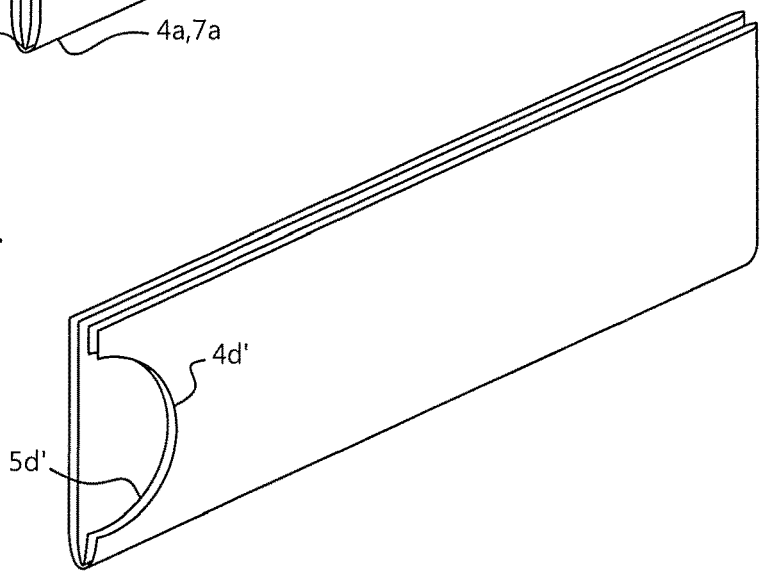
FIG. 4 shows a cut arcuate part.

In FIG. 4 there is shown how during a next stage identical arcuate parts have been cut from the cloth parts 4, 5, as a result of which the original free transverse edges 4*d*, 5*d* have obtained an at least substantially concave shape as indicated by numerals 4*d*' and 5*d*'. The cutting out of the parts in question could also have taken place at an earlier stage, for example in the situation shown in FIG. 1 or in the situation shown in FIG. 2, as is indicated in arcuate dotted lines in these figures.

Figure 5:
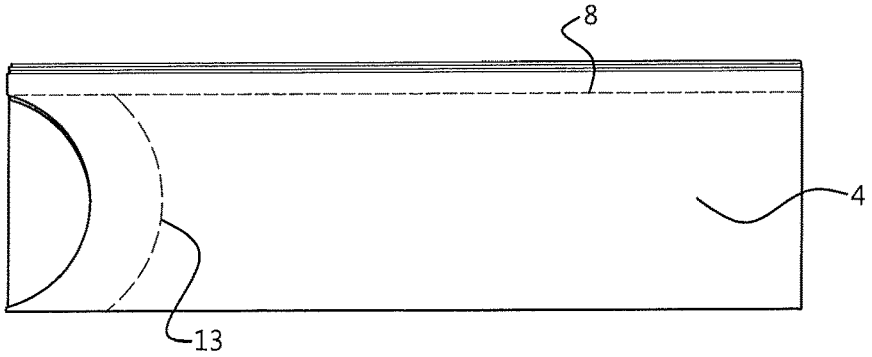
FIG. 5 shows the cloth stitched.

In FIG. 5 there is shown how the four cloth parts 4, 5, 6, 7 have been stitched together near the free longitudinal edges 4*b*, 5*b*, 6*b*, 7*b*, using a stitched seam 8, which thus extends through the four cloth parts 4, 5, 6, 7.

Figure 6:
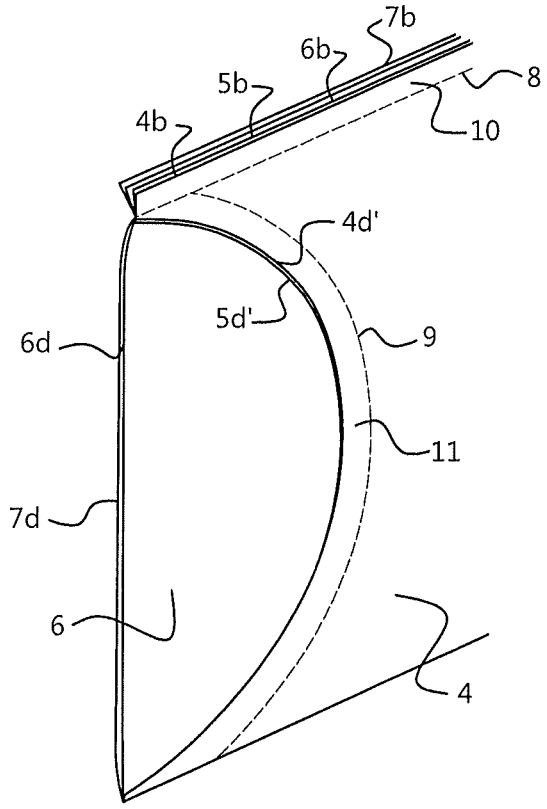
FIG. 6 is a detailed view showing the cloth stitched.
Figure 7:
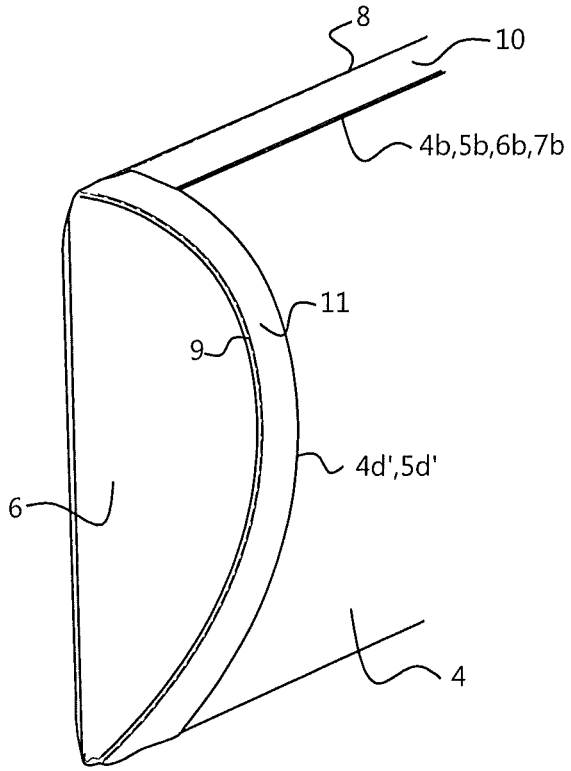
FIG. 7 shows further processing of the cloth.

Furthermore, as shown in FIG. 6, the cloth parts 4, 5 are stitched together near the transverse edges 4*d*', 5*d*' using a stitched seam 9 that follows the shape of the transverse edges 4*d*' and 5*d*'.

During a next stage, the strip 10 between the stitched seam 8 and the free longitudinal edges 4*b*, 5*b*, 6*b*, 7*b* is folded against the cloth part 4 about the fold line 8, and a tape is applied over the stitched seam 8 on the side of the cloth part 7, wherein the width of the tape is such that it will also bond to the cloth part 4 for keeping the strip 10 in contact with the cloth part 4. Furthermore, the strip 11 between the stitched seam 9 and the transverse edges 4*d*', 5*d*' is folded against set cloth part 4 about the stitched seam 9, and a tape is applied to the stitched seam 9 on the side of the cloth part 5, the width of which tape is such that it will also bond to the cloth part 4 for maintaining the folded position of the strip 11 about the stitched seam 9 against the cloth part 4.

The assembly of cloth parts is then turned inside out by gripping the transverse edges 4*c*, 5*c*, 6*c*, 7*c* and pulling them between the cloth parts 5, 6 in the direction of the transverse edges 4*d*', 5*d*', 6*d*, 7*d*. After that, a tape can be applied over the stitched seam 8 in a simple manner, which tape will bond to the cloth part 5 on one side of the stitched seam 8 and to the cloth part 6 on the other side.

The cloth package thus obtained is subsequently turned inside out by moving the transverse edges 6*c*, 7*c* between the cloth parts 6, 7, through the opening between the transverse edges, thereby positioning the cloth parts 4, 5 between the cloth parts 6, 7.

Figure 8:
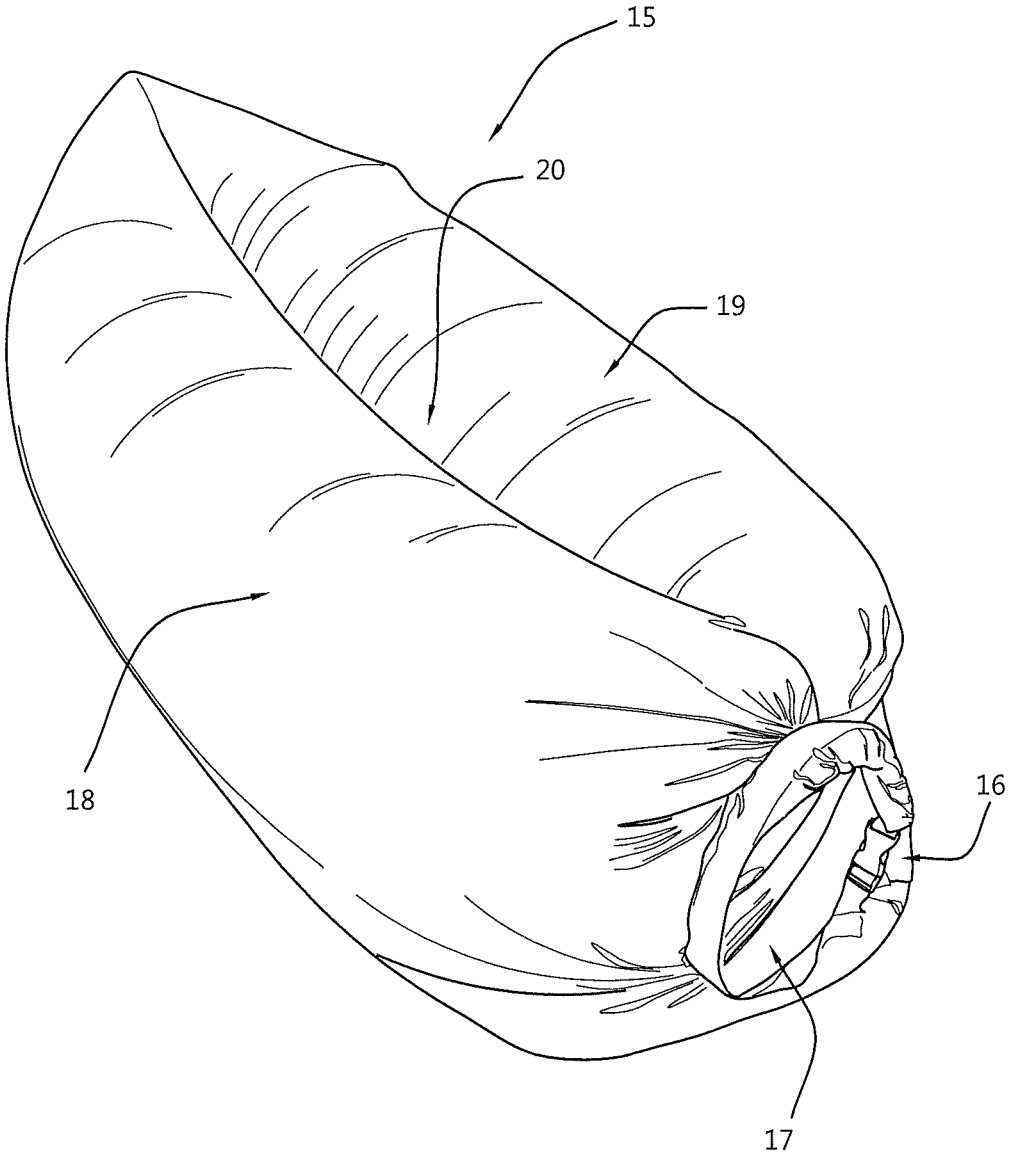
FIG. 8 shows the lounge bag inflated.

During the next stage, the sealing means for the final lounge bag as shown in FIG. 8 are attached to the cloth package. To that end a folded-over band with a flexible slat present therein is stitched to the cloth parts 6, 7 along the entire circumference of the transverse edges 6*d*, 7*d* on the facing sides of the cloth parts 6, 7. The slats extends along the entire length of the associated transverse edge portion 6d, 7d. At the two ends of the slats, buckle parts that can interlock, for example of the snap type, are provided.

In FIG. 8 the lounge bag 15 thus formed is shown in the position of use. To realise the position of use, an individual will move the opposite arcuate slats away from each other, so that the air inlet opening that is surrounded by the transverse edge portions 6*d*, 7*d* will be open. The air inlet opening is moved through the air in a direction perpendicular to the air inlet opening and away from the transverse edge portions 4*c*, 5*c*, 6*c*, 7*c* by the individual, so that air is captured in the interior space of the lounge bag. The individual will then close the air inlet opening by positioning the slats so that they butt against each other (with their flat sides). The individual will then roll the pair of slats about their longitudinal axis, as a result of which adjacent material of the cloth of the lounge bag 15 is wound around the pair of slats. To provide space for said winding whilst also retaining circulation of air inside the interior space, the hollow transverse edge portions 4*d*' and 5*d*' may also be located closer to the transverse edge portions 4*c*, 5*c*, as is shown in the arcuate dotted line 13 in FIG. 5. As a result of the aforesaid rolling up of the cloth around the pair of slats, pressure is built up in the interior space and the lounge bag 15 will bulge out to the shape shown in FIG. 8. The slats are then jointly bent and the buckle parts are coupled together, as is shown at 16, so that the slats with cloth material wound around them will retain their arcuate shape, as shown at 17, and air is prevented from escaping from the interior space of the lounge bag via the air inlet opening.

As shown in FIG. 8, in the position of use the lounge bag 15 has substantially the shape of two side-by-side tubes 18, 19 with a central gap 20 therebetween, which gap extends in the longitudinal direction of the lounge bag 15. The gap 20 has a substantially V-shaped cross-section, with the stitched seam 8 present between the four cloth parts 4, 5, 6 and 7 in the point of the V-shape.

As an alternative to the stitched seam 8 with the tape applied thereto, it would also possible within the scope of the invention to use other bonding techniques, whether or not in combination with each other or with the above-described bonding techniques, such as welding, for example thermosealing, or glueing together the butted-together cloth parts. In the case of welding, the material of the cloth must of course be suitable for being welded, as are, for example thermoplastic plastics such as polyvinyl chloride or polyester.

The invention claimed is:

1. A method for producing a lounge bag to be filled with air, the lounge bag comprising a container having a wall made of an airtight cloth and an interior space enclosed by the wall, the container having an air inlet opening for admitting air into the interior space when the air inlet opening is moved through air, the container having a seal for hermetically sealing the air inlet opening after air has been captured in the interior space, the method comprising the steps of:

(a) providing an elongate, at least substantially rectangular, cloth having two opposite transverse edges and two opposite longitudinal edges, wherein the cloth has first been folded double in a first direction about a first folding edge by placing the transverse edges one on top of the other and which has subsequently been folded double about a second folding edge in a second direction oriented perpendicular to the first direction, thus forming four cloth parts stacked against each other such that a first and a fourth cloth part are positioned on opposite outer sides, a second cloth part is positioned against the first cloth part, and a third cloth part is positioned between the second cloth part and the fourth cloth part;

(b) bonding the first cloth part and the second cloth part together on the side of the transverse edge to form an airtight seal;

(c) bonding the four opposite cloth parts together on the side of the longitudinal edges such that the longitudinal edges form part of the first cloth part up to and including the fourth cloth part, in a direction parallel to the longitudinal edges;

(d) turning the cloth with the bonded-together cloth parts from step (c) inside out by passing the first folding edge between the third cloth part and the fourth cloth part so that the first cloth part and the second cloth part are positioned between the third cloth part and the fourth cloth part and the air inlet opening is on the side opposite the first folding edge, such that the air inlet opening is surrounded by the transverse edge formed of the third cloth part and the fourth cloth part; and (e) fixing the seal to the transverse edge formed by the third cloth part and the fourth cloth part.

2. The method according to claim 1, wherein the four butted-together cloth parts are stitched together by a stitched seam during step (c).

3. The method according to claim 2, wherein tape is applied to the first cloth part and/or the fourth cloth part over the stitched seam after step (c).

4. The method according to claim 3, wherein prior to the step of applying the tape, the butted-together strips of cloth material positioned between the stitched seam and the respective longitudinal edges forming part of the four bonded-together cloth parts are folded about the stitched seam against the first cloth part or against the fourth cloth part, and wherein the tape is applied over the longitudinal edges that form part of the four bonded-together cloth parts.

5. The method according to claim 3, wherein subsequent to the step of applying the tape, a further tape is applied to the second cloth part and the third cloth part over the stitched seam.

6. The method according to claim 1, wherein prior to step (b) the transverse edges forming part of the first cloth part and the second cloth part are cut out such that the transverse edges forming part of the first cloth part and the second cloth part are concave, and wherein during step (b) the first cloth part and the second cloth part are bonded together.

7. The method according to claim 1, wherein step (e) comprises the steps of:

(i) attaching a first flexible slat having a length of at least substantially the entire length of the transverse edge forming part of the third cloth part to the third cloth part at the transverse edge thereof;

(ii) attaching a second flexible slat having a length of at least substantially the entire length of the transverse edge forming part of the fourth cloth part to the fourth cloth part at the transverse edge thereof; and (iii) providing a first connecting element to the lounge bag at ends located near each other of the first slat and the second slat and providing a second connecting element to the lounge bag at two ends located near each other, opposite said first ends, of the first slat and the second slat, wherein the first and second connecting elements are configured for interconnected cooperation in an abutting, jointly bent position of the first slat and the second slat to keep the first slat and the second slat in the bent position.

8. A lounge bag produced according to the method of claim 1, the lounge bag comprising a container having a wall made of an airtight cloth and an interior space enclosed by the wall, the container is provided with an air inlet opening for admitting air into the interior space via the air inlet opening as the air inlet opening is moved through air, the container comprising a seal for hermetically sealing the air inlet opening after air has been captured in the interior space, wherein the wall has four wall parts that form part of a folded cloth having two opposite transverse edges and two opposite longitudinal edges, the four wall parts butted together or at least positioned to butt together when the container is not filled with air, wherein the four cloth parts are bonded together on a side of the longitudinal edge forming part of the first cloth part up to and including the fourth cloth part and at a position where the four cloth parts are stacked to butt together, wherein two cloth parts located on the inner side, between the two other cloth parts located on the outer side, are bonded together to form an airtight seal on the side of the transverse edge forming part of the two cloth parts located on the inner side, and wherein the seal is fixed to the transverse edge forming part of the two cloth parts located on the outer side, wherein the transverse edge forming part of the two cloth parts located on the outer side surrounds the air inlet opening.

9. The lounge bag according to claim 8, wherein the first cloth part up to and including the fourth cloth part are stitched together using a stitched seam.

10. The lounge bag according to claim 9, wherein tape is applied over the stitched seam to the inner side of a cloth part located on the outer side and/or to the cloth part adjacent thereto, on the side thereof that faces the outer cloth part.

11. The lounge bag according to claim 10, wherein a further tape is applied over the stitched seam to the inner side of the other cloth part located on the outer side and/or to the cloth part adjacent thereto, on the side thereof that faces the other outer cloth part.

12. The lounge bag according to claim 8, wherein the transverse edge forming part of the two inner cloth parts is concave.

13. The lounge bag according to claim 12, wherein the transverse edge is free of angles.

14. The lounge bag according to claim 8, wherein the seal comprises a first flexible slat fixed to the transverse edge forming part of one of the two outer cloth parts and which has a length at least substantially equal to the length of the transverse edge forming part of the one cloth part, and a second flexible slat fixed to the transverse edge forming part of other of the two outer cloth parts and which has a length at least substantially equal to the length of the transverse edge forming part of the other cloth part, and a first connecting element at ends located near each other of the first slat and the second slat and a second connecting element at second ends located near each other, opposite the first ends, of the first slat and the second slat, the first and second connecting elements configured for being interconnected such that when the first slat and the second slat are located opposite each other in a jointly bent position the first and second slats are held in the bent position.

* * * * *